US009951489B2

(12) United States Patent
Rong

(10) Patent No.: US 9,951,489 B2
(45) **Date of Patent: *Apr. 24, 2018**

(54) PET WASTE COLLECTOR

(71) Applicant: Kebin Rong, Alhambra, CA (US)

(72) Inventor: Kebin Rong, Alhambra, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/681,418

(22) Filed: Aug. 20, 2017

(65) Prior Publication Data

US 2017/0342670 A1 Nov. 30, 2017

Related U.S. Application Data

(63) Continuation-in-part of application No. 15/259,016, filed on Sep. 7, 2016, now Pat. No. 9,771,697, which is a continuation of application No. 14/797,169, filed on Jul. 12, 2015, now Pat. No. 9,469,950.

(51) Int. Cl.
*E01H 1/12* (2006.01)

(52) U.S. Cl.
CPC ... *E01H 1/1206* (2013.01); *E01H 2001/1226* (2013.01)

(58) Field of Classification Search
CPC .... A41D 13/08; A41D 13/081; A41D 19/015; A41D 19/0055; A41D 19/01505; A41D 2600/20; A61B 19/04; E01H 1/1206; A01K 23/005; A01K 1/0107; A61F 13/105
USPC ..... 2/16, 20, 59, 161.6, 161.7
See application file for complete search history.

(56) References Cited

U.S. PATENT DOCUMENTS

| | | | | | |
|---|---|---|---|---|---|
| 4,788,733 | A * | 12/1988 | Lerner | A41D 19/0075 | 15/104.94 |
| 5,186,506 | A * | 2/1993 | Gale | E01H 1/1206 | 294/1.3 |
| 5,222,777 | A * | 6/1993 | Clonch | E01H 1/1206 | 294/1.3 |
| 7,216,905 | B1 * | 5/2007 | Armes, Jr. | E01H 1/1206 | 294/1.3 |
| 2009/0315350 | A1 * | 12/2009 | Allen | E01H 1/1206 | 294/1.3 |
| 2010/0084880 | A1 * | 4/2010 | Avilez | E01H 1/1206 | 294/1.3 |
| 2010/0176611 | A1 * | 7/2010 | Merino-Garcia | E01H 1/1206 | 294/1.3 |
| 2011/0210571 | A1 * | 9/2011 | Dan | A41D 19/0024 | 294/1.3 |

* cited by examiner

*Primary Examiner* — Stephen A Vu
(74) *Attorney, Agent, or Firm* — Raymond Y. Chan; David and Raymond Patent Firm

(57) ABSTRACT

A waste collector includes a bag body and a waste collecting apparatus. The bag body, which is made of flexible material, has a top opening and a waste collecting cavity. The waste collecting apparatus includes two elongated scraper arms spacedly affixed at the bag body to partition the bag body into a first bag portion and a second bag portion. When the bag body is reversibly flipped inside out from the top opening to form a temporary waste cavity within the first bag portion of the bag body, the scraper arms are moved toward each other for enclosing the temporary waste cavity within the first bag portion of the bag body and for scraping a waste within the temporary waste cavity. Therefore, the bag body is flipped back for automatically retaining the waste in the waste collecting cavity from the temporary waste cavity.

14 Claims, 12 Drawing Sheets

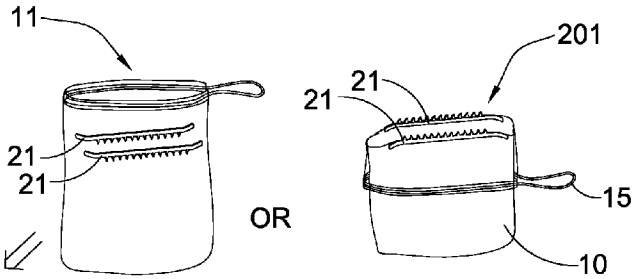
FIG.3A
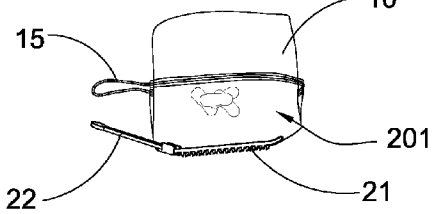
FIG.3B
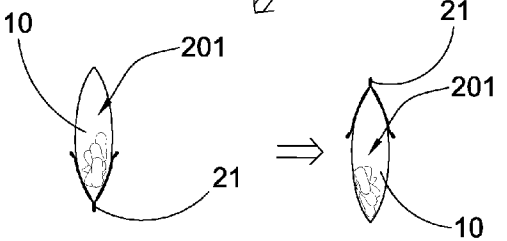
FIG.3C
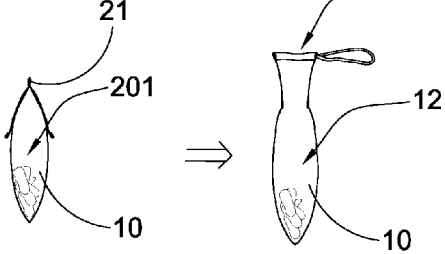
FIG.3D
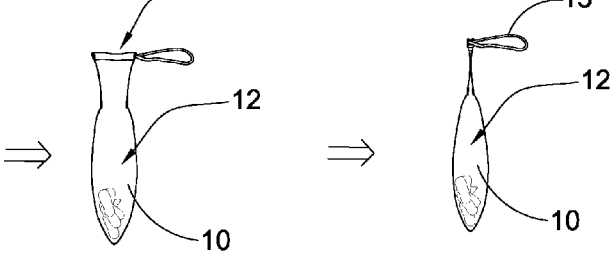
FIG.3E
FIG.3F 15A
10A 15A
10A
20A
22A
21A 10A
15A
22A
20A
21A
21A 10A
12A
10A
12A
11A
10A
120A 11A
10A
12A
10A
120A
15A
12A
10A

PET WASTE COLLECTOR

CROSS REFERENCE OF RELATED APPLICATION

This is a Continuation-In-Part application that claims the benefit of priority under 35 U.S.C. § 120 to a non-provisional application, application Ser. No. 15/259,016, filed Sep. 7, 2016, issued on Sep. 26, 2017, U.S. Pat. No. 9,771,697, which is a Continuation application that claims the benefit of priority under 35 U.S.C. § 120 to a non-provisional application, issued on Oct. 18, 2016, U.S. Pat. No. 9,469,950. The afore-mentioned patent application is hereby incorporated by reference in its entirety.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a waste bag such as pet waste bag, and more particular to a waste collector, which provides two scraper arms at the bag body for scraping pet wastes into the bag body.

DESCRIPTION OF RELATED ARTS

Dogs tend to excrete while they are walked. It is the duty of the dog's owner to clean up the dog's fecal waste in private or public areas. One of the most important responsibilities is to pick up the fecal waste when they are walking their pets in a public place. In addition, many countries have laws and regulations that require pet's owners to pick up their pet's fecal waste. Otherwise, the pet's owners may receive citations. However once the fecal waste fall on the ground or grass, it is difficult to collect them completely.

Most pet's owners carry a pet waste bag in order to pick up and collect the waste. There are many different bag dispensers in the market for the pet's owner to carry the pet waste bags during walking the pet. However, the pet waste bag has several drawbacks. In order to pick up the waste on the ground or grass, the pet's owner will usually insert one hand into the pet waste bag and scoop the waste by the hand into the pet waste bag. It is a chore for the pet's owner to pick up the waste by hand even though the hand is covered by the pet waste bag. Most of the pet's owners feel totally disgusting when gripping or touch the waste by hand. Furthermore, the size of the pet waste bag is usually way larger than the hand size of the pet's owner. It is a waste to collect small amount of waste in a big bag. If the size of the pet waste bag is reduced, the hand of the pet's owner is hard to insert into the pet waste bag. Even though the hand of the pet's owner fits into the pet waste bag, the pet waste bag is difficult to flip inside out with the hand therein after picking up the waste. In addition, the pet waste bag is easily dirty when picking up the waste. As a result, the hand of the pet's owner will eventually get dirty when tying up the pet waste bag.

A picking tool is provided in the market to pick up the waste from the ground into the pet waste bag, such that the pet's owner does not have to scoop the waste by his or her own hand. The picking tool generally comprises a handle and a scooping head such that the pet's owner can grip the pet waste bag by one hand and hold the handle by another hand to scoop the waste by the scooping head into the pet waste bag. In other words, the pet's owner requires both hands to complete the waste collecting process. It is inconvenient for the pet's owner since the pet's owner must grip the pet leash by one hand. Thus, the pet's owner must carry the dirty picking tool after the use thereof.

SUMMARY OF THE PRESENT INVENTION

The invention is advantageous in that it provides a waste collector such as a pet waste collector, which provides two scraper arms at the bag body for scraping wastes such as pet wastes into the bag body.

Another advantage of the invention is to provide a waste collector, wherein two scraper arms are symmetrically arranged on to opposed sides of the bag body respectively to scrap the waste into the bag body.

Another advantage of the invention is to provide a waste collector, wherein each of the scraper arms has serrated edge for enhancing the scraping operation of the waste.

Another advantage of the invention is to provide a waste collector, wherein the top opening of the bag body is always kept clean during the collecting process.

Another advantage of the invention is to provide a waste collector, wherein the scraper arms can be operated via a scraping actuator which is detachably coupled with the scraper arms, such that the user is able to re-use the scraping actuator to other bag body with the built-in scraper arms.

Another advantage of the invention is to provide a waste collector, wherein the size of the bag body can be minimized to collect the waste, so as to minimize the material waste of the bag body.

Another advantage of the invention is to provide a waste collector, wherein manufacturing process of the pet waste collector is simple and easy by affixing the scraper arms at the surface of any waste bag. In other words, the scraper arms can be incorporated with any existing waste bag without altering the original structure thereof.

Another advantage of the invention is to provide a waste collector, wherein the user is able to easily complete the waste collecting process by one hand.

Another advantage of the invention is to provide a waste collector, wherein no expansive and complicated structure is required to be employed in the present invention in order to achieve the above mentioned objects. Therefore, the present invention successfully provides an economic and efficient solution that allows the user easily pick up and collect the waste without touching the waste by the user hand.

Another advantage of the invention is to provide a waste collector, wherein the waste collector is able to save the cost of collecting the waste each time.

Another advantage of the invention is to provide a waste collector such as pet waste collector, wherein the bag body for collecting the waste such as pet waste is able to be used any type of collector, there is no requirement of the size, material or structure of the bag body.

Another advantage of the invention is to provide a waste collector, wherein the bag body is able to be opened through the waste collecting apparatus to collect the waste.

Another advantage of the invention is to provide a waste collector, wherein the handle of the waste collecting apparatus is easy to be carried to avoid the waste collecting apparatus is fall off during collecting the waste.

Another advantage of the invention is to provide a waste collector, wherein the scraper arms of the waste collector is able to be used for collecting the waster easily.

Another advantage of the invention is to provide a waste collector, wherein the each of the scraper arm further comprises a series of scraping teeth and at least a blade for scraping the waste clean.

Another advantage of the invention is to provide a waste collector, wherein the waste collecting apparatus of the pet waste collector further comprises two actuator arms to drive the scraper arms to collecting the waste easily.

Another advantage of the invention is to provide a waste collector, wherein the scraper arms is able to be detached from the actuator arms of the waste collecting apparatus to replace the scraper arms if the scraper arms is broken.

Another advantage of the invention is to provide a waste collector, wherein the scraper arms is able to be detached from the actuator arms of the waste collecting apparatus to clean the scarped arms if the scraper arms is dirty.

Another advantage of the invention is to provide a waste collector, wherein the pet waste collector will not be touched the ground during collecting the pet waste.

Another advantage of the invention is to provide a waste collector, wherein the handle is made of nonslip materials such that the waste collector will not be fall off from the hand of the user easily.

Additional advantages and features of the invention will become apparent from the description which follows, and may be realized by means of the instrumentalities and combinations particular point out in the appended claims.

According to the present invention, the foregoing and other objects and advantages are attained by a waste collector, comprising a bag body and a waste collecting apparatus. In one embodiment, the waste collector is embodied as a pet waste collector.

The bag body, which is made of flexible material, has a top opening and a waste collecting cavity.

The waste collecting apparatus comprises two elongated scraper arms spacedly affixed at the bag body to partition the bag body into a first bag portion between the scraper arms and a second bag portion as the rest portion of the bag body. When the bag body is reversibly flipped inside out from the top opening, the scraper arms are moved toward each other to form a temporary waste cavity within the first bag portion of the bag body for scraping a waste such as pet waste within the temporary waste cavity. Therefore, the bag body is flipped back for automatically retaining the waste in the waste collecting cavity from the temporary waste cavity.

As a transformation of the above waste collecting apparatus, the waste collecting apparatus comprises two elongated scraper arms for collecting the waste into said waste collecting cavity through said top opening of said bag body and a scraping actuator for driving said scraper arms to collect the waste, wherein said two scraper arms are detachably fixed on said scraping actuator of said waste collecting apparatus.

In accordance with another aspect of the invention, the present invention comprises a method for collecting waste such as pet waste by a waste collector, comprising the following steps.

(1) Provide a bag body with two elongated scraper arms which are spacedly affixed at the bag body and located away from the top opening to partition the bag body into a first bag portion between the scraper arms and a second bag portion as the rest portion of the bag body.

(2) Reversibly flip the bag body inside out from the top opening to form a temporary waste cavity within the first bag portion of the bag body.

(3) Scrape the pet waste by moving the scraper arms toward each other so as to collect the waste within the temporary waste cavity.

(4) Flip the bag body back for automatically retaining the waste in the waste collecting cavity from the temporary waste cavity.

As a choice, the present invention comprises a method for collecting waste such as pet waste by a waste collector, comprising the following steps.

(1) provide a bag body with a waste collecting cavity formed between two bag sheets and a top opening for collecting the waste;

(2) flip said bag body inside out from said top opening other to from a temporary waste cavity within said waste collecting cavity thereof;

(3) scrape the pet waste by moving two scraper arms which are acted on said two bag sheets respectively toward each other; and (4) flip said bag body back for the waste in said waste collecting cavity from said temporary waste cavity.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

FIGS. 3A to 3F illustrate a method for picking up and collecting the waste by the waste collector according to the above preferred embodiment of the present invention.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
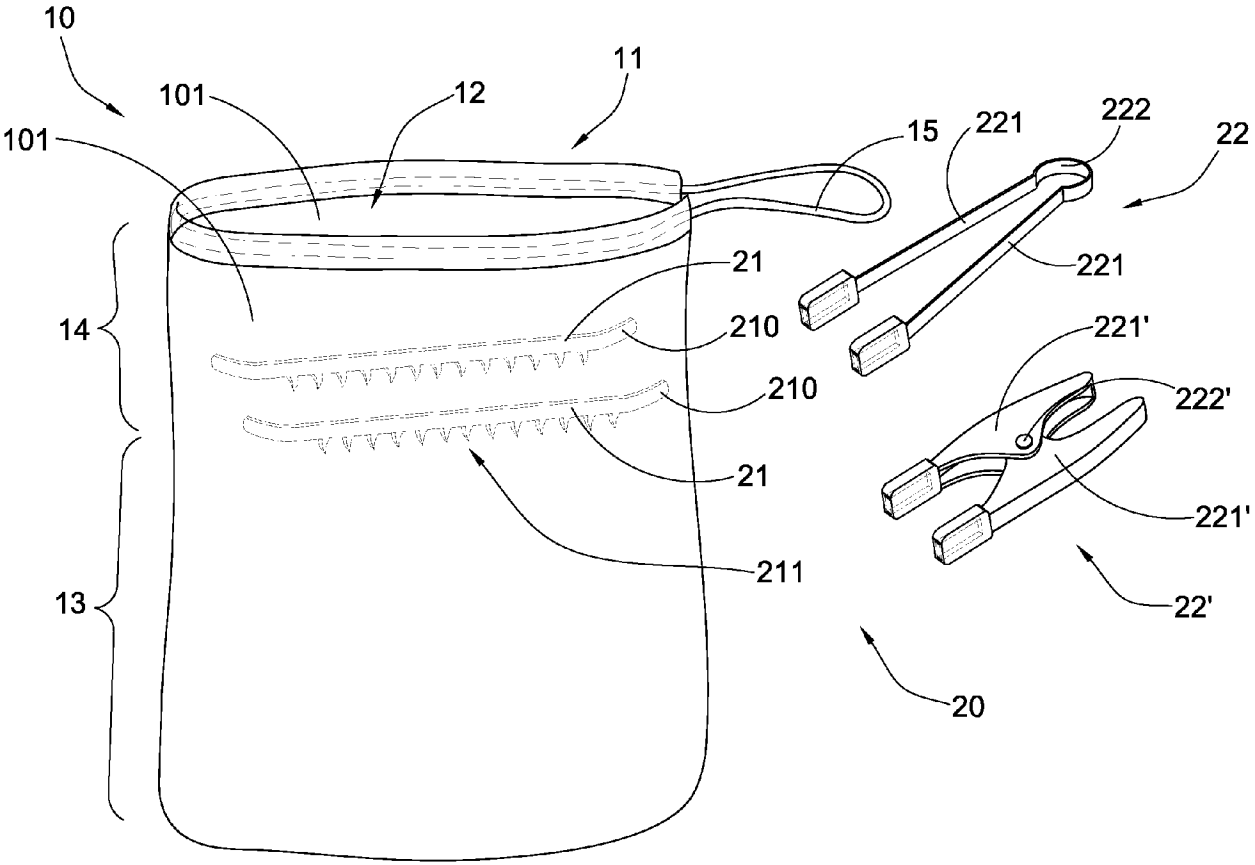
FIG. 1 is a perspective view of a waste collector according to a preferred embodiment of the present invention.
Figure 2:
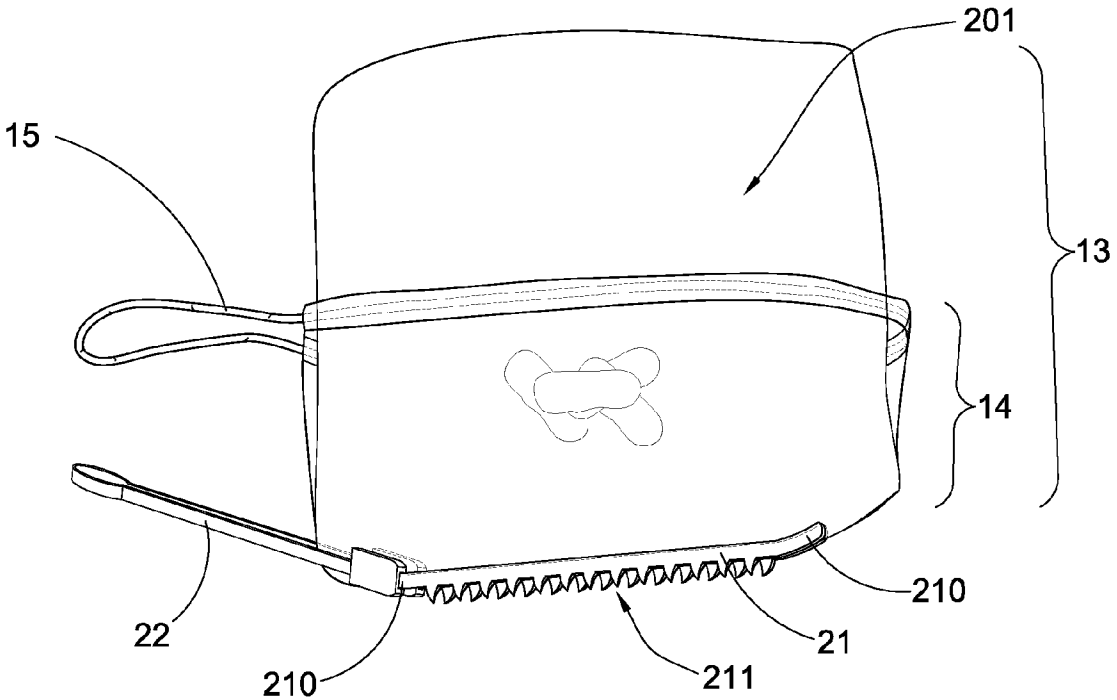
FIG. 2 is a sectional view of the waste collector according to the above preferred embodiment of the present invention, illustrating the bag body reversibly flipped inside out from the top opening to form the temporary waste cavity.

Referring to FIGS. 1 and 2 of the drawings, a waste collector which is embodied as a waste collector according to a preferred embodiment of the present invention is illustrated, wherein the waste collector comprises a bag body 10 for collecting a waste and a waste collecting apparatus 20 for picking the waste into the bag body 10.

The bag body 10, which is made of flexible material, has a top opening 11 and a waste collecting cavity 12. Preferably, the bag body 10 is made of biodegradable plastic adapted to be decomposed.

As shown in FIG. 1, the bag body 10 comprises two bag sheets 101 overlappedly with each other to form the waste collecting cavity 12 between the bag sheets 101. The bag sheets 101 can be formed by two individual sheets affixed with each other edge-to-edge, or can be formed by one single sheet overlappedly folded in half. For example, each of the bag sheets 101 has a rectangular shape, wherein three edges of the bag sheets 101 are sealed correspondingly while one of the edges of each bag sheet 101 is remained unsealed to form the top opening 11 of the bag body 10. It is appreciated that the bag body 10 can be configured to have different sizes and different shapes as long as the bag body 10 is large enough to collect the waste, i.e. the pet waste. Preferably, the width of the bag body 10 is not larger than an opening size of the top opening 11 thereof. In other words, the opening size of the top opening 11 of the bag body 10 should equal to or larger than the width of the waste collecting cavity 12 of the bag body 10.

The waste collecting apparatus 20 comprises two elongated scraper arms 21 spacedly affixed at the bag body 10 to partition the bag body 10 into a first bag portion 13 and a second bag portion 14. The first bag portion 13 of the bag body 10 is a portion defined between the scraper arms 21. The second bag portion 14 of the bag body 10 is defined at the rest portion thereof.

As shown in FIG. 1, the scraper arms 21 are affixed at the bag sheets 101 respectively. In particular, the scraper arms 21 are symmetrically affixed at inner sides of the bag sheets 101 respectively. Preferably, the scraper arms 21 can be affixed on the inner sides of the bag sheets 101 respectively by ultrasonic connection or adhesive. The scraper arms 21 are made of rigid material stiffer than the bag body 10. For example, the scraper arms 21 can be made of plastic, preferably biodegradable plastic.

In addition, the scraper arms 21 are identical and parallel with each other. More importantly, the scraper arms 21 are affixed to the bag body 10 with a distance away from the top opening 11 thereof. Preferably, the scraper arms 21 are affixed to the one-third of the bag body 10 from the top opening 11 thereof. The scraper arms 21 are also parallel to the top opening 11 of the bag body 10.

Accordingly, each of the scraper arms 21 is configured to form a strip, wherein a longitudinal length of each of the scraper arms 21 is smaller than the width of the bag body 10. It is worth mentioning that the longitudinal length of each of the scraper arms 21 can be maximized via the width of the bag body 10 to enhance the scraping operation of the scraper arms 21.

As shown in FIGS. 1 and 2, each of the scraper arms 21 has a serrated shape, wherein each of the scraper arms 21 has a plurality of scraping teeth 211 formed along a longitudinal edge thereof for further enhancing the scraping operation when the scraper arms 21 are moved toward each other. Accordingly, the scraping teeth 21 of each of the scraper arms 21 are pointing toward a bottom of the bag body 10, i.e. away from the top opening 11 thereof. Preferably, each of the scraping teeth 21 has a curved shape, as shown in FIG. 2, to serve as a clawing tooth to scrape the waste when the scraper arms 21 are moved toward each other. In particular, the scraping teeth 21 at one scraper arm 21 are misaligned with the scraping teeth 21 at another scraper arm 21, such that when the scraper arms 21 are moved toward each other, the scraping teeth 21 at one scraper arm 21 are alternating with the scraping teeth 21 at another scraper arm 21. In other words, the scraping teeth 21 at one scraper arm 21 are engaged with the gaps between the scraping teeth 21 at another scraper arm 21.

As the bag body 10 is partitioned by the scraper arms 21, the first bag portion 13 of the bag body 10 is formed at the bottom portion thereof between the scraper arms 21 and the bottom side of the bag body 10 as shown in FIG. 1. The second bag portion 14 of the bag body 10 is formed at the upper portion thereof between the scraper arms 21 and the top opening 11 of the bag body 10 as shown in FIGS. 1 and 2.

According to the preferred embodiment, when the bag body 10 is reversibly flipped inside out from the top opening 11 to the scraper arms 21, the second bag portion 14 of the bag body 10 is overlapped with and covered by the first bag portion 13, as shown in FIG. 2, to form a temporary waste cavity 201 within the first bag portion 13 of the bag body 10. In other words, the temporary waste cavity 201 is formed at a portion of the waste collecting cavity 12. It is worth mentioning that the scraper arms 21 are flipped upside-down that the scraping teeth 21 of each of the scraper arms 21 are pointing downward at the opening of the temporary waste cavity 201, as shown in FIG. 2.

In particular, the temporary waste cavity 201 is formed at the bottom portion of the waste collecting cavity 12. Preferably, the second bag portion 14 of the bag body 10 is formed at the upper portion thereof between the scraper arms 21 and the top opening 11 of the bag body 10 as shown in FIGS. 1 and 2. Therefore, the volume of the temporary waste cavity 201 is about two-third of the waste collecting cavity 12. It is appreciated that when the scraper arms 21 are located between the top opening 11 and the bottom of the bag body 10, the volume of the temporary waste cavity 201 is about two-third of the waste collecting cavity 12. Preferably, the volume of the temporary waste cavity 201 is at least half of the waste collecting cavity 12.

The scraper arms 21 are moved toward each other to enclose the temporary waste cavity 201 within the first bag portion 13 of the bag body 10. When moving the scraper arms 21 toward each other, i.e. the scraper arms 21 are moved alongside with each other, the scraper arms 21 are also arranged for scraping the waste within the temporary waste cavity 201, as shown in FIGS. 3B and 3C. In other words, when the bag body 10 is reversibly flipped inside out from the top opening 11, the scraper arms 21 are formed along an opening of the temporary waste cavity 201. Therefore, when the scraper arms 21 are moved toward each other to enclose the temporary waste cavity 201. Through the scraping teeth 211 at each of the scraper arms 21, the scraper arms 21 can easily scrape the waste into the temporary waste cavity 201 and to close the temporary waste cavity 201 at the same time. It is worth mentioning that the scraping teeth 211 of the scraper arms 21 are formed along the opening of the temporary waste cavity 201. Therefore, the bag body 10 is then flipped back for automatically retaining the waste in the waste collecting cavity 12 from the temporary waste cavity 201, as shown in FIG. 3E.

As shown in FIGS. 1 and 2, the bag body 10 further comprises a drawstring 15 extended around the top opening 11 for tie-closing the waste collecting cavity 12 after the waste is collected therein.

In order to move the scraper arms 21, the waste collecting apparatus 20 further comprises a scraping actuator 22 detachably coupled with the scraper arms 21 to drive the scraper arms 21 for picking up the waste into the temporary waste cavity 201. As shown in FIG. 1, the scraping actuator 22 comprises two actuator arms 221 pivotally coupled with each other, wherein each of the actuator arms 221 has a detachable end detachably coupled with a free end portion 210 of the scraper arm 21, such that when the actuator arms 221 are pivotally moved, the scraper arms 21 are driven to move toward each other and away from each other. It is worth mentioning that the scraper arms 21 are affixed to the bag body 10 except the free end portions 210 of the scraper arms 21. Therefore, the detachable ends of the actuator arms 221 can be detachably coupled at the free end portions 210 of the scraper arms 21 respectively. In addition, the free end portion 210 of each of the scraper arms 21 is an angled end portion, wherein an angle between an elongated body of the scraper arm 21 and the free end portion 210 is an obtuse angle. Preferably, each of the actuator arms 221 also has an angled end to detachably couple at the free end portion 210 of the scraper arm 21, as shown in FIG. 1. Alternatively, each of the actuator arms 221 can be an elongated straight arm to detachably couple at the free end portion 210 of the scraper arm 21, as shown in FIG. 2. Therefore, the actuator arms 221 are upwardly and inclinedly extended from the opening of the temporary waste cavity 201 when the scraping actuator 22 detachably coupled with the scraper arms 21. In other words, the user is able to easily actuate the scraping actuator 22 to drive the scraper arms 21 for picking up the waste on the ground without touching the ground.

Preferably, the two actuator arms 221 are pivotally coupled with each other end-to-end via a spring-loaded pivot joint 222 to form the scraping actuator 22 with a V-shaped configuration. In other words, each of the actuator arms 221 further has an opposed pivot end, wherein the pivot ends of the actuator arms 221 are pivotally coupled by the spring-loaded pivot joint 222 and the detachable ends of the actuator arms 221 are detachably coupled with the free ends of the scraper arms 21 respectively. Therefore, when the user holds the actuator arms 221 and applies a compression force thereto, the scraper arms 21 are driven to move toward each other. Once the compression force is released, the spring-loaded pivot joint 222 will push the actuator arms 221 pivotally moved away from each other so as to move the scraper arms 21 away from each other.

Likewise, the two actuator arms 221' are pivotally coupled with each other via a pivot joint 222' to form the scraping actuator 22' with a scissor-like configuration, such that the user is able to operate the actuator arms 221' to move the scraper arms 21 toward each other and away from each other. Preferably, each of the actuator arms 221' also has an angled end to detachably couple at the free end portion 210 of the scraper arm 21, as shown in FIG. 1. It is worth mentioning that after collecting the waste in the bag body 10, the scraping actuator 22, 22' can be detached from the scraper arms 21, such that the scraping actuator 22 is reusable to couple with another set of scraper arms 21 at the bag body 10.

As shown in FIGS. 3A to 3F, a method for collecting the waste such as waste by the waste collector is illustrated, where the method comprises the following steps.

(1) Provide the bag body 10 with two elongated scraper arms 21 spacedly built-in with the bag body 10 to partition the bag body 10 into the first bag portion 13 and the second bag portion 14, as shown in FIG. 3A. Accordingly, the temporary waste cavity 201 is formed at the first bag portion 13 of the bag body 10 within the waste collecting cavity 12 thereof.

(2) Reversibly flip the bag body 10 inside out from the top opening 11. Accordingly, the second bag portion 14 of the bag body 10 is overlapped with and covered by the first bag portion 13, as shown in FIG. 3A, to form the temporary waste cavity 201 within the first bag portion 13 of the bag body 10. In other words, the temporary waste cavity 201 will be exposed when the bag body 10 is flipped. Thus, the scraper arms 21 are formed along an opening of the temporary waste cavity 201. Preferably, the scraping actuator 22 is detachably coupled to the scraper arms 21 before the bag body 10 is flipped to expose the temporary waste cavity 201.

It is worth mentioning that the bag body 10 can be a folded in a compact size. In particular, the bag body 10 can be formed with its original shape as shown in FIG. 3A, such that the user is able to reversibly flip the bag body 10 before it is used. Likewise, the bag body 10 can be pre-folded with the flipped shape as shown in FIG. 3A, such that the user is able to use the flipped bag body 10 right a way.

(3) Scrape the waste by moving the scraper arms 21 toward each other to collect the waste within the temporary waste cavity 201, as shown in FIG. 3C. Accordingly, the bag body 10 is placed upside-down at a position that the opening of the temporary waste cavity 201 is facing downwardly toward the waste. When the scraper arms 21 are moved toward each other, the temporary waste cavity 201 is closed by the scraper arms 21. The scraping teeth 21 of the scraper arms 21 will help to scrape the waste from the ground into the temporary waste cavity 201. It is worth mentioning that the user is able to actuate the scraping actuator 22 to move the scraper arms 21 toward each other, as shown in FIG. 3B.

(4) Flip the bag body 10 back for automatically retaining the waste in the waste collecting cavity 12 from the temporary waste cavity 201, as shown in FIGS. 3D and 3E. Once the temporary waste cavity 201 is closed by the scraper arms 21 to store the waste in the temporary wastes cavity 210, the user is able to place the bag body 10 at a position that the opening of the temporary waste cavity 201 is facing upward, such that the waste will be dropped at the bottom of the bag body 10. Then, the user is able to flip the bag body 10 back to its original condition by unfolding the second bag portion 14 of the bag body 10 from the first bag portion 13, as shown in FIGS. 3D and 3E. Then the waste will be collected in the waste collecting cavity 12. It is worth mentioning that when flipping the bag body 10, the user is able to hold the scraping actuator 22 to carry the bag body 10 and to maintain the temporary wastes cavity 210 in a closed condition at the same time. Therefore, the closed temporary wastes cavity 210 will reduce the smell of the waste to escape therefrom and will keep the second bag portion 14 of the bag body 10 clean.

(5) Tie-close the waste collecting cavity 12 by the drawstring 15 extended around the top opening 11 after the waste is collected in the waste collecting cavity 12, as shown in FIG. 3F. It is worth mentioning that the user is able to hold the scraping actuator 22 to carry the bag body 10 and to pull the drawstring 15 for closing the waste collecting cavity 12 at the same time. Therefore, the hand of the user will not touch any portion of the bag body except the drawstring 15. Once the waste collecting cavity 12 is closed by the drawstring 15, the scraping actuator 22 can be detached from the scraper arms 21. Since the scraping actuator 22 will not touch the waste during the scraping operation, the user can keep the scraping actuator 22 clean.

It is worth mentioning that the scraper arms 21 can be optionally removed from the bag body 10 after the waste collecting process is completed. The user is able to simply detach the scraper arms 21 from the bag body 10 or to keep the scraper arms 21 at the bag body 10.

Referring to FIGS. 4 to 6B, a waste collector embodied as a pet waste collector according to a second preferred embodiment of the present invention is illustrated, wherein the waste collector comprises a bag body 10 for collecting a waste and a waste collecting apparatus 20 for picking the waste into the bag body 10.

Figure 4:
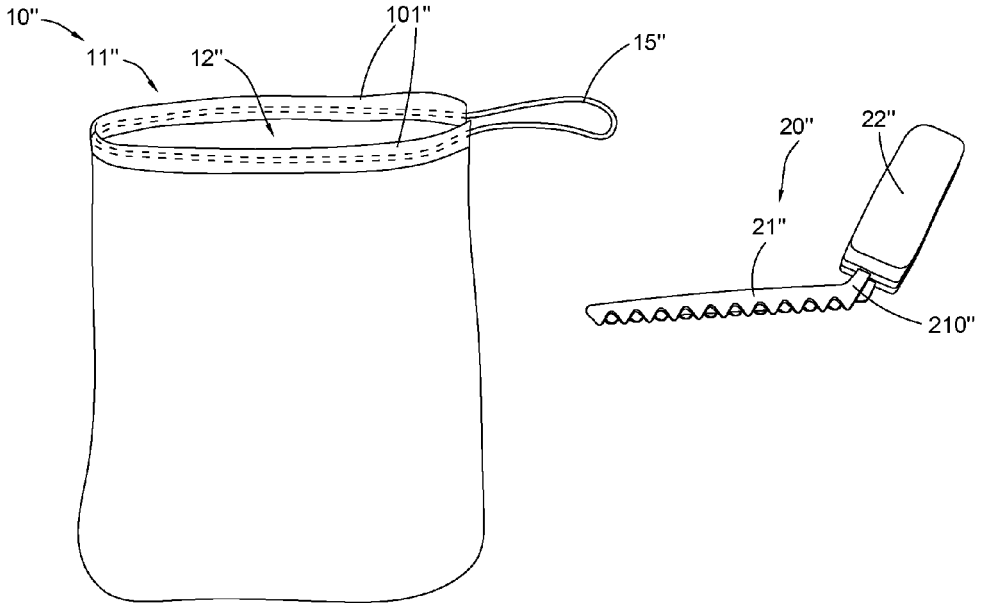
FIG. 4 is a perspective view of a waste collector according to a second preferred embodiment of the present invention.

As shown in FIG. 4, the bag body 10" comprises two bag sheets 101" which are used to form a waste collecting cavity 12" for collecting the waste. The bag body 10' further has a top opening 11" which is located on the top of the bag body 10". Through the top opening 11" into the waste collecting cavity 12" for collecting the pet's waste.

The bag body 10" is made of flexible material for folding to match up the waste collecting apparatus 20" to collect the waste. Preferably, the bag body 10" is made of biodegradable plastic adapted to be decomposed to avoid the environment is polluted by the bag body 10".

As shown in FIG. 4, the bag body 10" further comprises two bag sheets 101" overlappedly with each other, and the waste collecting cavity 12" is formed between the bag sheets 101". The bag sheets 101" can be formed by two individual sheets which are affixed with each other edge-to-edge, or can be formed by one single sheet overlappedly folded in half. For example, each of the bag sheets 101" has a rectangular shape, wherein three edges of the bag sheets 101" are sealed corresponding while one of the edges of each bag sheet 101" is remained unsealed to for the top opening 11" of the bag body 10". It is appreciated that the bag body 10" can be configured to have different sizes and different shapes as long as the bag body 10' is large enough to collect the waste, such as the waste.

Preferably, the width of the top of the bag body 10" is no less than the width of other part of the bag body 10" which is under the top of the bag body 10". In other words, the width of the top opening 11" is equal to or large than the width of other part of the bag body 10" to ensure the top opening 11" is folded on other part easily.

The waste collecting apparatus 20" comprises two elongated scraper arms 21" to collect the waste and the scraper arms 21" are made of rigid material stiffer than the bag body 10". For example, the scraper arms 21" can be made of plastic, preferably biodegradable plastic.

Accordingly, each of the scraper arms 21" is configured to form a strip, wherein a longitudinal length of each of the scraper arms 21" is equal to or larger than the width of the bag body 10". It is worth to mention that the longitudinal length of each of the scraper arms 21" can be maximized via the width of the bag body 10" to enhance the scraping operation of the scraper arms 21".

Figure 5A:
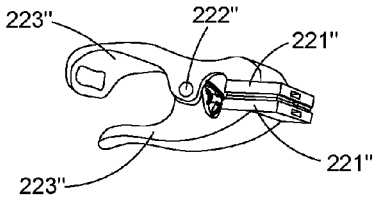
FIG. 5A to 5D illustrate the structure of the waste collecting apparatus according to the above second preferred embodiment of the present invention.
Figure 5B:
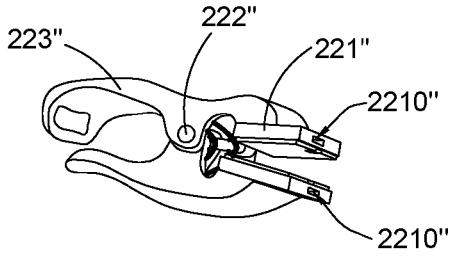
Figure 5C:
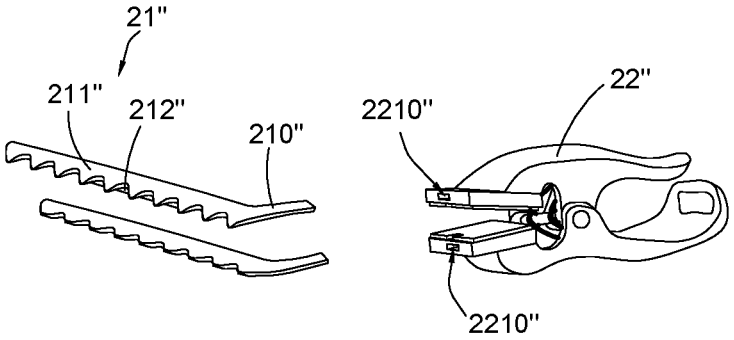
Figure 5D:
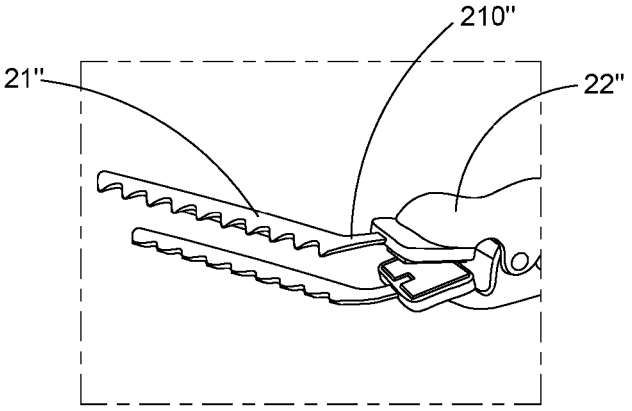

As shown in FIGS. 4 and 5C to 5D, each of the scraper arms 21" has a serrated shape, wherein each of the scraper arms 21" has a plurality of scraping teeth 211" which are formed along a longitudinal edge thereof for further enhancing the scraping operation when the scraper arms 21" are moved toward each other. Accordingly, the scraping teeth 211" of each of the scraper arms 21" are pointing toward to the earth when it is used to scrape the waste.

Preferably, each of the scraping teeth 211" has a curved shape, as shown in FIG. 5D, to serve as a clawing tooth to scrape the waste when the scraper arms 21" are moved toward each other. In particular, the scraping teeth 211" at one scraper arm 21" are misaligned with the scraping teeth 211" at the other scraper arm 21", such that when the scraper arms 21" are moved toward each other, the scraping teeth 211" at one scraper arm 21" are alternating with the scraping teeth 211" at the other scraper arm 21". In other words, the scraping teeth 21" at one scraper arm 21" are engaged with the gaps between the scraping teeth 21" at the other scraper arm 21".

Furthermore, each of the scraper arms 21" further comprises a blade 212" fixed on the reverse side of the scraping teeth 211", wherein the side of the blade 212" is under the peak of the scraping teeth 211" of the scraper arms 21". In other words, the side of the blade 212" is parallel with the peak of the scraping teeth 211" of the scraper arms 21". Therefore, the blade 212" is able to enhance the scraping operation when the scraper arms 21" are moved toward each other preferably, because the blade 212" is able to scrape the waste which is omitted through the interval of the scraping teeth 211" when it is moved toward each other with the actuator arms 221" of the scraping actuator 22".

It is worth to mention that each of the scraping teeth 211" of the scraper arms 21" is curved toward each other, so the scraper arms 21" has a holding power when the two scraper arms 21" are moved toward to each other to hold the waste. In other words, when the scraper arms 21" of the waste collecting apparatus 20" are moved toward each other, it is not only has a scrape power to scrape the waste but also has a holding power to holding the waste in the waste collecting cavity 12" of the bag body 10". In addition to the above, if the ground or the grass is not flat, the scarper arms 21" is also able to be used for scraping the waste.

According to the second preferred embodiment, when the bag body 10" is reversibly flipped inside out from the top opening 11", the upper of the bag body 10" drove by the top opening 11" will overlapped and covered sectional the other part of the bag body 10" to form a temporary waste cavity 120" within the waste collecting cavity 12" of the bag body 10". In other words, the temporary waste cavity 120" is formed at a portion of the waste collecting cavity 12". In particular, the temporary waste cavity 120" is formed at the bottom portion of the waste collecting cavity. Preferably, the folding place of the bag body 10" is located at the upper portion thereof for providing the temporary waste cavity 120" to collect the waste, in the meanwhile, the distance between the top opening 11" and the folding place should ensure that the temporary waste cavity 120" of the bag body 10 drove by the scraper arms 21" is large to collect the waste. In other words, the waste and the scraper arms 21" is able to open the temporary waste cavity 120" too big to collect the waste.

The scraper arms 21" are moved toward each other to enclose the temporary waste cavity 120" within the bag body 10". When moving the scraper arms 21" toward each other, such as the scraper arms 21" are moved alongside with each other, the scraper arms 21" are also arranged for scraping the waste within the temporary waste cavity 120". In other words, when the bag body 10" is reversibly flipped inside out from the top opening 11", the scraper arms 21" are formed along an opening of the temporary waste cavity 120". Therefore, when the scraper arms 21" are moved toward each other to enclose the temporary waste cavity 120". Through the scraping teeth 211" at the scraper arms 21", the scraper can easily scrape the waste into the temporary waste cavity 120" and to close the temporary waste cavity 120" at the same time. Therefore, the bag baby 10" is flipped back for automatically retaining the waste in the waste collecting cavity 12" from the temporary waste cavity 120".

Figure 6A:
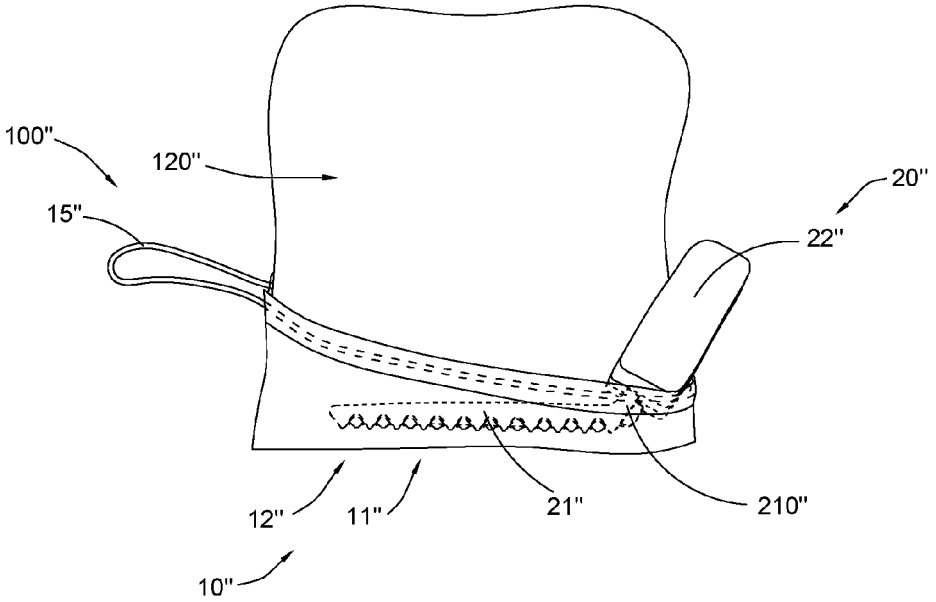
FIG. 6A to 6B illustrate the section view of the waste collector according to the above second preferred embodiment of the present invention, illustrating the bag body reversibly flipped inside out from the top opening to form the temporary waste cavity.
Figure 6B:
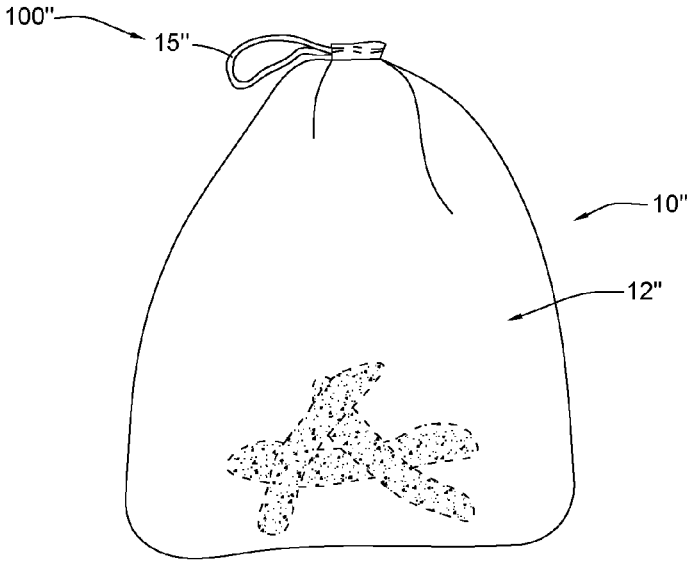

As shown in FIGS. 4 and 6A to 6B, the bag body 10" further comprises a joint part 100" for remaining the waste collecting cavity 12" in a closed position. The joint part 100" of the second preferred embodiment is a drawstring 15" extended around the top opening for tie-closing the waste collecting cavity 12" after the waste is collected therein.

In order to move the scraper arms 21", the waste collecting apparatus 20" further comprises a scraping actuator 22" detachably coupled with the scraper arms 21" to drive the scraper arms 21" for picking up the waste into the temporary waste cavity 120". As shown in FIG. 5A to 5B, the scraping actuator 22" comprises two actuator arms 221" pivotally coupled with each other, wherein each of the actuator arms 221" has a hole 2210", each of the holes 2210" is formed at a detachable end of the actuator arms 221" respectively. Each of the scraper arms 211" is connected to a corresponding actuator arm 221" through take a free end portion 210" of the scraper arms 21" into the corresponding holes 2210" respectively, such that when the actuator arms 221" are pivotally moved, the scraper arms 21" are driven to move toward each other or away from each other. It is worth to mention that the scraper arms 21" are detachably connected to the actuator arms 221" of the scraping actuator 22" such that if the scraper arms 21" are polluted by the waste while collecting the waste, the scraper arms 21" is able to be detached to clean or discard from the actuator arms 221" of the scraping actuator 22".

Preferably, the two actuator arms 221" are pivotally coupled with each other end-to-end through a spring-loaded pivot joint 222" to form the scraping actuator 22" with a V-shaped configuration. In other words, each of the actuator arms 221" further has an opposed pivot end, wherein the pivot ends of the actuator arms 221" are pivotally coupled by the spring-loaded pivot joint 222" and the detachable ends of the actuator arms 221" are detachably coupled with the free ends portion 210" of the scraper arms 21" through the hole 2210" respectively. Therefore, when the user hold the actuator arms 221" and applies a compression force thereto, the scraper arms 21" are driven to move away from each other so as to move the scraper arms 21" away from each other. Once the compression force is released, the spring-loaded pivot joint 222" will push the actuator arms 221" pivotally moved toward each other so as to move the scraper arms 21" toward each other.

It is worth to mention that each of the free end 210" of the scraper arms 21" further has an angle for coupling with the actuator arm 221" of the scraping actuator 22", that is, each of the free end portion 210" of the scraper arms 21" is angled relative to the scraper arm 21" and the body of the waste collecting apparatus 20" is above the extended line of the scraper arms 21" when the scraper arms 21" are scraped the waste on the ground by the user. In other words, when the user collect the waste through the scraper arms 21" of the waste collecting apparatus 20", the scraper arms 21" will be scraped on the ground, and the scraping actuator 22" will not be touched the ground because of the angle of the free end portion 210" so that the scraping actuator 22" will not be dirty during collecting the waste. The two scraper arms 21" are coupled with the two actuator arms 221" of the scraping actuator 22" through taking the free end portions 210" into the hole 2210" of the actuator arms 221" respectively.

Furthermore, the waste collecting apparatus 20" further comprises two handles 223" used for operating the actuator arms 221" of the scraping actuator 22" through the spring-loaded pivot joint 222" to drive the scraper arms 21" toward each other or away from each other to collect the waste, wherein each of the handles 223" is extended from the pivot ends of the actuator arms 221" respectively for the user to carry. It is worth to mention that after collecting the waste in the bag body 10", the scraper arms 21" of the waste collecting apparatus 20" can be detached from the actuator arms 221" of the scraping actuator 22", such that the scraping actuator 22" is reusable to couple with another set of scraper arms 21", such as the scraper arms 21" is discarded and so on. In addition, the scraper arms 21" is easy to be handled after it is detached from the actuator arms 221" of the scraping actuator 22", such as clean and so on.

It is worth to mention that the outside surface of the handles 223" is made of non-slip materials for avoiding the waste collecting apparatus 20" is falling off from the user during collecting the waste, such as rubber or silica gel and so on.

Figure 7A:
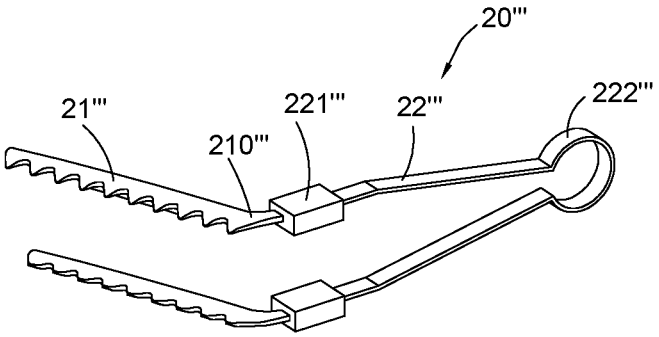
FIG. 7A to 7B illustrate a structure of an alternative of the waste collecting apparatus according to the above second preferred embodiment of the present invention.
Figure 7B:
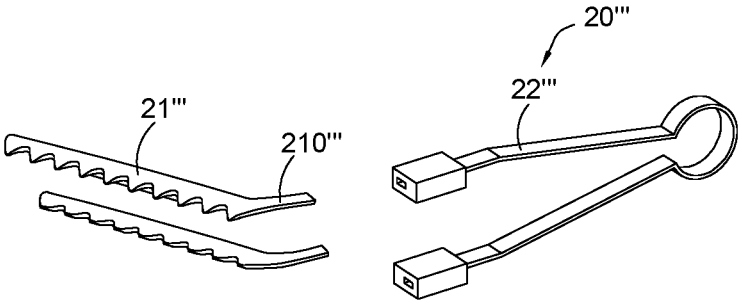

Likewise, as shown in FIGS. 7A to 7B , the two actuator arms 221'" are pivotally coupled with each other via a pivot joint 222'" to form the scraping actuator 22'" with a scissor-like configuration, such that the user is able to operate the actuator arms 221'" to move the scraper arms 21'" toward each other and away from each other. Preferably, each of the actuator arms 221'" also has an angled end to detachably couple at the free end portion 210'" of the scraper arm 21'", as shown in FIG. 4. It is worth mentioning that after collecting the waste in the bag body 10", the scraping actuator 22", 22" can be detached from the scraper arms 21", such that the scraping actuator 22" is reusable to couple with another set of scraper arms 21" at the bag body 10".

Figure 8B:
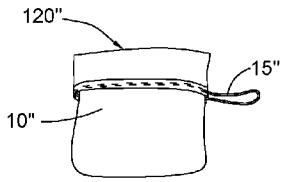
FIGS. 8A to 8I illustrate a method for picking up and collecting the waste by the waste collector according to the above second preferred embodiment of the present invention.
Figure 8A:
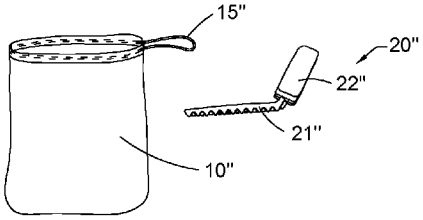
Figure 8C:
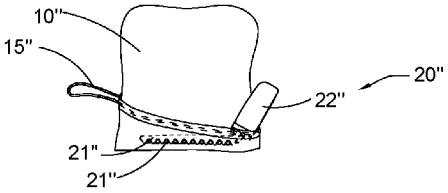

As shown in FIGS. 8A to 81, a method for collecting the waste by the waste collector is illustrated, where the method comprises the following steps.

(1) Flip inside out the bag body 10" from the top opening 11" to form the temporary waste cavity 120" within the waste collecting cavity 12" thereof. In other words, the temporary waste cavity 120" will be exposed when the bag body 10" is flipped. Preferably, the scraping actuator 22" is detachably coupled to the scraper arms 21" before the bag body 10" is flipped to expose the temporary waste cavity 120" and the scraper arms 21", and the two scraper arms 21" are located on the out surface of the two bag sheets 101" of the bag body 10" respectively.

Figure 8D:
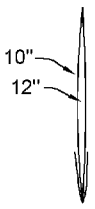
Figure 8E:
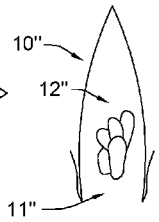

(2) Move the scraper arms 21" away from each other through apply a compression force to drive the two bag sheets 101" away from each other to open the temporary waste cavity 120", as shown in FIG. 8D to 8E.

Figure 8F:
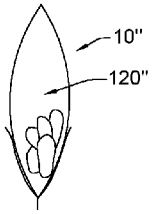

(3) Scrape the waste by moving the scraper arms 21" toward each other to collect the waste within the temporary waste cavity 120", as shown in FIG. 8E to 8F. When the scraper arms 21" are moved toward each other, the temporary waste cavity 120" is closed by the scraper arms 21". The scraping teeth 221" of the scraper arms 21" will help to scrape the waste from the ground or the grass into the temporary waste cavity 120". It is worth to mention that the user is able to actuate the scraping actuator 22" to move the scraper arms 21" toward each other.

Figure 8G:
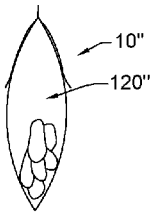
Figure 8H:
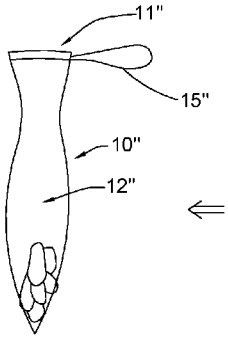

(4) Flip the bag body 10" back for automatically retaining the waste in the waste collecting cavity 12" from the temporary waste cavity 120", as shown in FIGS. 8G to 8H. Once the temporary waste cavity 120" is closed by the scraper arms 21" to store the waste in the temporary waste cavity 21", the user is able to flip the bag body 10" back to its original condition by unfolding the bag body 10".

Figure 8I:
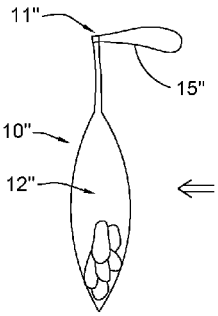

(5) Tie-close the waste collecting cavity 12" by the drawstring 15" extended around the top opening 11" after the waste is collected in the waste collecting cavity 12", as shown in FIG. 8I. It is worth to mention that the user is able to hold the scraping actuator 22" to carry the bag body 10" and to pull the drawstring 15" for closing the waste collecting cavity 12" at the same time to reduce the smell of the waste to escape the waste collecting cavity 12" and will keep the bag body 10" clean. Therefore, the hand of the user will not touch any portion of the bag body except the drawstring 15". Once the waste collecting cavity 12" is closed by the drawstring 15", the scraper arms 21" of the waste collect apparatus 20" can be detached from the bag body 10". Since the scraper arms 21" of the scraping actuator 22" of the waste collecting apparatus 20" will not touch the waste during the scraping operation, the user can keep the scraper arms 21" of the waste collecting apparatus 20" clean.

It is worth to mention that the scraper arms 21" can be optionally removed from the scraping actuator 22" of the waste collecting apparatus 20" after the waste collecting process is completed. The user is able to simply process the scraper arms 21" from the waste collecting apparatus 20" such as clean or discard or store and so on.

Figure 9A:
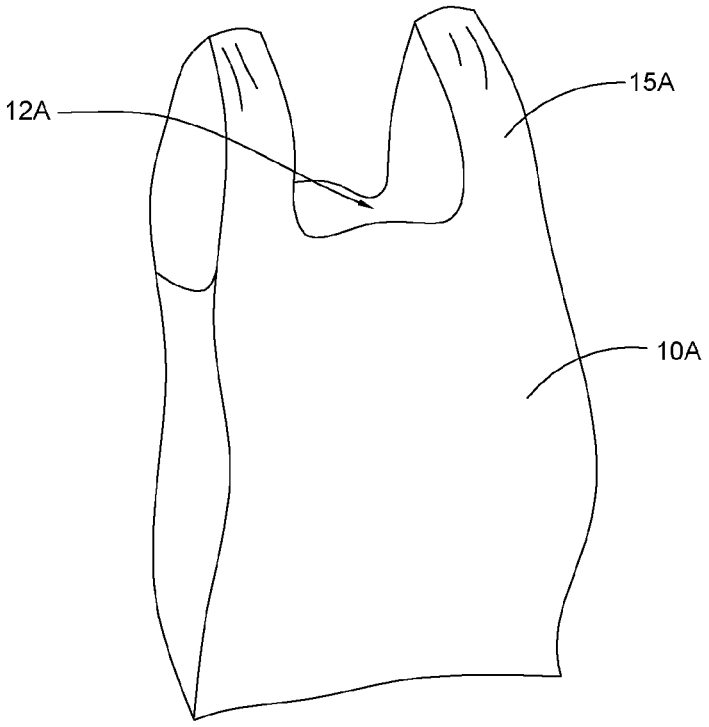
FIGS. 9A to 9B illustrate a perspective view of the first alternative of the bag body according to the above second preferred embodiment of the present invention.
Figure 9B:
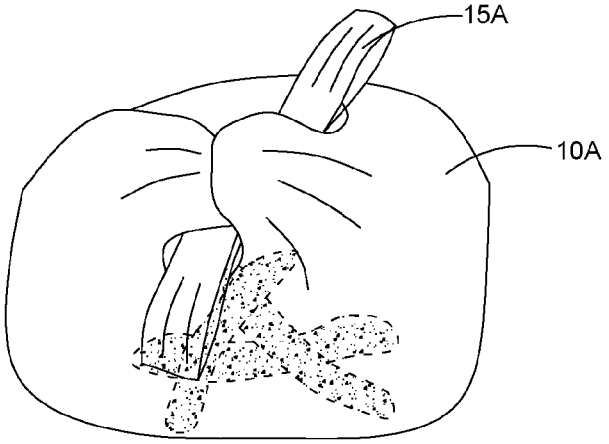

A transformation of the bag body 10 of the second preferred embodiment, as shown in FIGS. 9A to 9B, the drawstring 15 is transformed as two holders 15A. In detail, the bag body 10A has two holders 15A upwardly extended from the top of the two bag sheets respectively, wherein each of the holders 15A has a space 150A, the user is able to carry the bag body 10 through the spaces 150A or fasten the bag body 10A on a fixed place and so on. It is worth to mention that the user is able to tie top opening 11A of the bag body 10A to prevent or reduce the smell of the waste to escape therefrom and prevent the waste fall off from the waste collecting cavity 12A of the bag body 10A. At the same time, the hand of the user will not touch the waste even through the hand is covered by the bag body 10A.

In addition, the user is easily take the bag body 10A to any place through the holders 15A, because the two holders 15A are extended from the top of the two bag sheets 101A, so the force loading from the waste in the bag body 10A is uniform. Thus, the bag body 10A is not broken when it is carried by the user. In other words, the user is able to take the bag body 10A anywhere through with the hand cross the spaces 150A of the holders 15A to carry the holders 15A of the bag body 10A and don't worry the bag body 10A will be broken.

As shown in FIGS. 10A to 10I, a method for collecting the waste by the waste collector is illustrated, where the method comprises the following steps.

(1) Flip inside out the bag body 10A from the top opening 11A to form the temporary waste cavity 120A within the waste collecting cavity 12A thereof. In other words, the temporary waste cavity 120A will be exposed when the bag body 10A is flipped. Preferably, the scraping actuator 22A is detachably coupled to the scraper arms 21A before the bag body 10A is flipped to expose the temporary waste cavity 120A and the scraper arms 21A, and the two scraper arms 21A are located on the out surface of the two bag sheets 101A of the bag body 10A respectively.

Figures 10A, 10B, 10C, 10D, 10E, 10F, 10G, 10H, 10I:
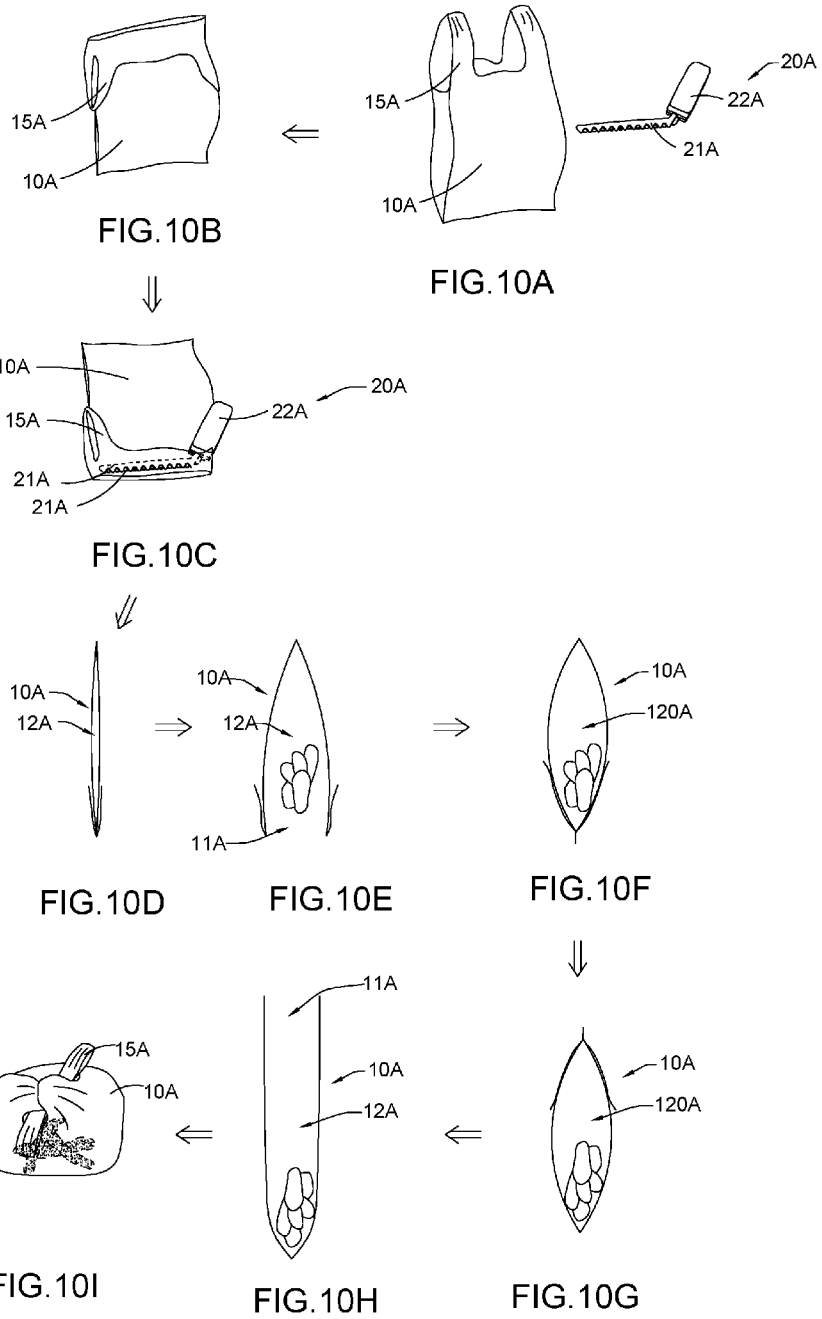
FIGS. 10A to 10I illustrate a method for picking up and collecting the waste by the waste collector according to the first alternative of the bag body of the above second preferred embodiment of the present invention.

(2) Move the scraper arms 21A away from each other through apply a compression force to drive the two bag sheets 101A away from each other to open the temporary waste cavity 120A, as shown in FIGS. 10D to 10E.

(3) Scrape the waste by moving the scraper arms 21A toward each other to collect the waste within the temporary waste cavity 120A, as shown in FIGS. 10E to 10F. When the scraper arms 21A are moved toward each other, the temporary waste cavity 120A is closed by the scraper arms 21A. The scraping teeth 221A of the scraper arms 21A will help to scrape the waste from the ground or the grass into the temporary waste cavity 120A. It is worth to mention that the user is able to actuate the scraping actuator 22A to move the scraper arms 21A toward each other.

(4) Flip the bag body 10A back for automatically retaining the waste in the waste collecting cavity 12A from the temporary waste cavity 120A. Once the temporary waste cavity 120A is closed by the scraper arms 21A to store the waste in the temporary waste cavity 21A, the user is able to flip the bag body 10A back to its original condition by unfolding the bag body 10A, as shown in FIGS. 10G to 10H.

(5) Tie-close the waste collecting cavity 12A by the two holders 15A extended from the top of the two bag sheets 101A after the waste is collected in the waste collecting cavity 12A, as shown in 10I. It is worth to mention that the user is able to hold the two holders 15A together to carry the bag body 10A and to maintain the waste collecting cavity 12A in a closed condition through tie the two holders 15A together. Therefore, the closed waste collecting cavity 12A will reduce the smell of the waste to escape therefrom and will keep the bag body 10A clean. Therefore, the hand of the user will not touch any portion of the bag body except the holders 15A. Once the waste collecting cavity 12A is closed by the holders 15A, the scraper arms 21A of the waste collect apparatus 20A can be detached from the bag body 10A. Since the scraper arms 21A of the scraping actuator 22A of the waste collecting apparatus 20A will not touch the waste during the scraping operation, the user can keep the scraper arms 21A of the waste collecting apparatus 20A clean.

Figure 11A:
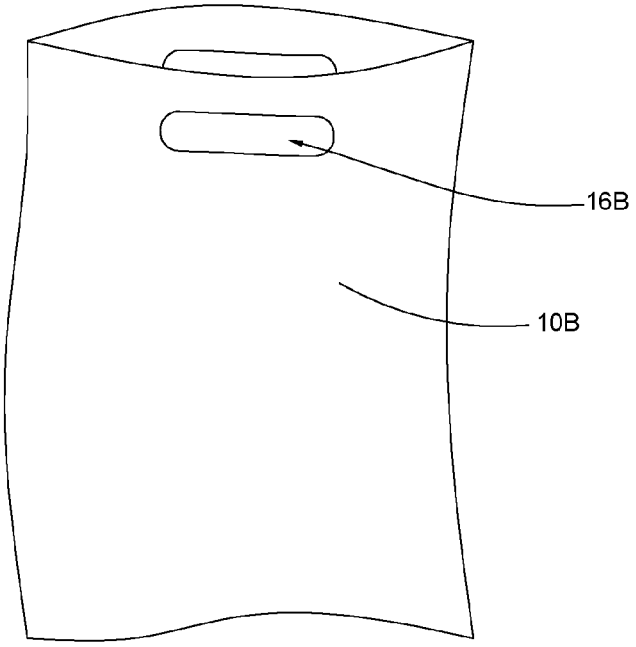
FIGS. 11A to 11B illustrate a perspective view of the second alternative of the bag body according to the above second preferred embodiment of the present invention.
Figure 11B:
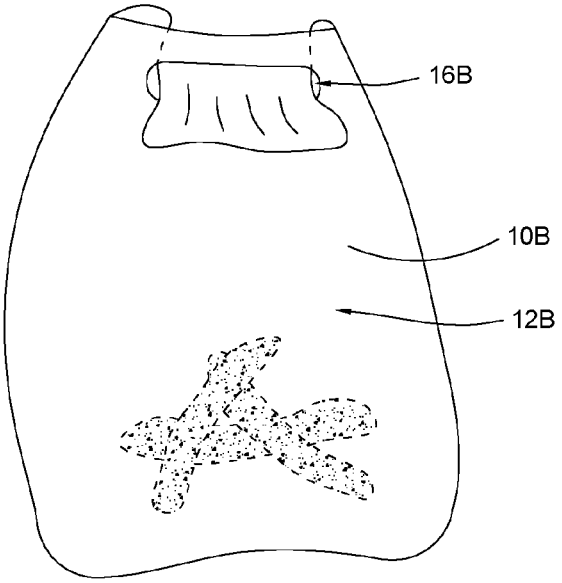

Another transformation of the bag body 10B of the second preferred embodiment, as shown in FIG. 11A to 11B, the bag body 10B further has at least one sealing slit 16B for sealing the bag body 10B. Referring to FIG. 11A, the sealing slit 16B is cut in U-shape on each of the bag sheets 101B near the top opening 11B of the bag body 10B. The upper edge 161B of the sealing slit 16B can be lift up to make a through hole the top edge of the bag sheet 101B to be pulled through. When the bag body 10B need to be closed, the edge of the bag sheet 101B which is opposite to the sealing slit 16B is pulled through the sealing slit 16B from one side to another, then the bag sheet 101B of the bag body 10B is squeezed and sealed. The sealing slit 16B holds the edge of the bag sheet 101B for fastening. In this way, no other fasteners, such as rubber band, thread, or clamps are needed for sealing the bag body 10B.

As shown in FIGS. 12A to 12I, a method for collecting the waste by the waste collector is illustrated, where the method comprises the following steps.

(1) Flip inside out the bag body 10B from the top opening 11B to form the temporary waste cavity 120B within the waste collecting cavity 12B thereof. In other words, the temporary waste cavity 120B will be exposed when the bag body 10B is flipped. Preferably, the scraping actuator 22B is detachably coupled to the scraper arms 21B before the bag body 10B is flipped to expose the temporary waste cavity 120B and the scraper arms 21B, and the two scraper arms 21B are located on the out surface of the two bag sheets 101B of the bag body 10B respectively.

Figure 12B:
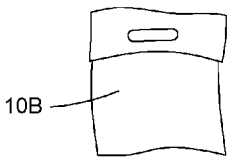
FIGS. 12A to 12I illustrate a method for picking up and collecting the waste by the waste collector according to the second alternative of the bag body of the above second preferred embodiment of the present invention.
Figure 12A:
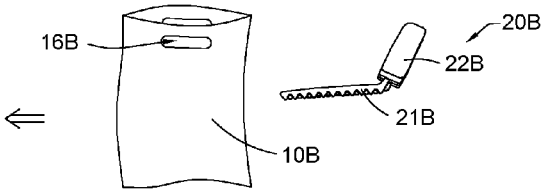
Figure 12C:
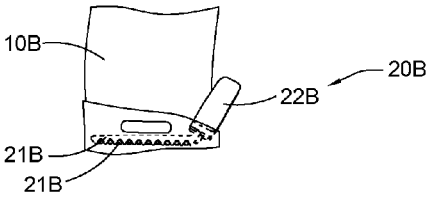
Figure 12D:
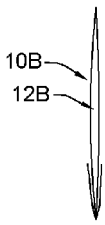

(2) Move the scraper arms 21B away from each other through apply a compression force to drive the two bag sheets 101B away from each other to open the temporary waste cavity 120B, as shown in FIGS. 12D to 8E.

Figure 12E:
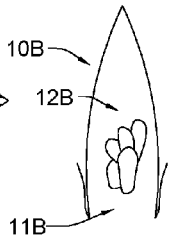
Figure 12F:
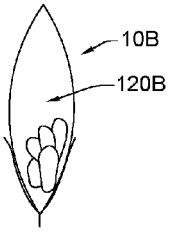

(3) Scrape the waste by moving the scraper arms 21B toward each other to collect the waste within the temporary waste cavity 120B, as shown in FIGS. 12E to 12F. When the scraper arms 21B are moved toward each other, the temporary waste cavity 120B is closed by the scraper arms 21B. The scraping teeth 221B of the scraper arms 21B will help to scrape the waste from the ground or the grass into the temporary waste cavity 120B. It is worth to mention that the user is able to actuate the scraping actuator 22B to move the scraper arms 21B toward each other.

Figure 12G:
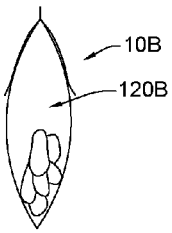
Figure 12H:
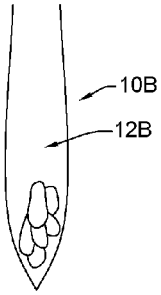

(4) Flip the bag body 10B back for automatically retaining the waste in the waste collecting cavity 12B from the temporary waste cavity 120B, as shown in FIGS. 12G to 12H. Once the temporary waste cavity 120B is closed by the scraper arms 21B to store the waste in the temporary waste cavity 21B, the user is able to flip the bag body 10B back to its original condition by unfolding the bag body 10B.

Figure 12I:
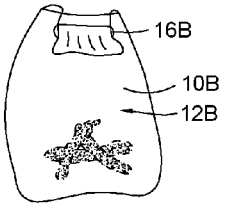

(5) Tie-close the waste collecting cavity 12B by pulling the bag sheet 101B across the sealing slit 16B which is on the opposite bag sheet 101B from one side to another after the waste is collected in the waste collecting cavity 12B, as shown in FIG. 12I. It is worth to mention that sealing slit 16B is able to maintain the waste collecting cavity 12B in a closed condition. Therefore, the closed waste collecting cavity 12B will reduce the smell of the waste to escape therefrom and will keep the bag body 10B clean. Therefore, the hand of the user will not touch any portion of the bag body except the edge of the sheets 101B. Once the waste collecting cavity 12B is closed by the sealing slit 16B and the edge of the bag sheet 101B of the bag body 10B, the scraper arms 21B of the waste collect apparatus 20B can be detached from the bag body 10B. Since the scraper arms 21B of the scraping actuator 22B of the waste collecting apparatus 20B will not touch the waste during the scraping operation, the user can keep the scraper arms 21B of the waste collecting apparatus 20B clean.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A waste collector for collecting waste, comprising:

a bag body, which is made of flexible material, having a top opening and a waste collecting cavity and comprising two bag sheets overlapped with each other to form said waste collecting cavity between said bag sheets; and a scraping actuator and a waste collecting apparatus which comprises two elongated scraper arms extended from said scraping actuator, wherein said scraper arms are operated and driven by said scraping actuator to separate said two bag sheets to opening said top opening of said bag body and collecting the waste into said waste collecting cavity through said top opening of said bag body, and that said two scraper arms are able to be operated and driven by said scraping actuator to move toward each other for enclosing said waste collecting cavity, wherein said two scraper arms are detachably fixed to said scraping actuator.

2. A waste collector for collecting waste, comprising:

a bag body, which is made of flexible material, having a top opening and a waste collecting cavity and comprising two bag sheets overlapped with each other to form said waste collecting cavity between said bag sheets; and a scraping actuator and a waste collecting apparatus which comprises two elongated scraper arms extended from said scraping actuator, wherein said scraper arms are operated and driven by said scraping actuator to separate said two bag sheets to opening said top opening of said bag body and collecting the waste into said waste collecting cavity through said top opening of said bag body, and that said two scraper arms are able to be operated and driven by said scraping actuator to move toward each other for enclosing said waste collecting cavity, wherein each of said scraper arms comprises a plurality of scraping teeth formed along a longitudinal edge thereof for enhancing a scraping operation when said scraper arms are moved toward each other.

3. The waste collector, as recited in claim 2, wherein each of said arms comprises a blade fixed on the reverse side of said scraping teeth, wherein the side of said blade up to the peak of said scraping teeth of said scraper arms.

4. The waste collector, as recited in claim 3, wherein said scraping actuator of said waste collecting apparatus further comprises two actuator arms pivotally coupled with each other for driving said two scraper arms to scrape the waste respectively, wherein each of said scraper arms is coupled with said actuator arm respectively.

5. The waste collector, as recited in claim 4, wherein each of said scraper arms has a free end portion and each of said actuator arms has a detachable end detachably coupled with said free end portion of said scraper arm respectively, such that when said actuator arms are pivotally moved, said scraper arms are driven to move toward each other and away from each other.

6. The waste collector, as recited in claim 5, wherein each of said scraper arms has an opposed pivot end and said scraping actuator further comprises a spring-loaded pivot joint located at said opposed pivot end, wherein said two actuator arms are pivotally coupled with each other end-to-end through said spring-loaded pivot joint to form said scraping actuator with a V-shaped configuration.

7. The waste collector, as recited in claim 6, wherein each of said actuator arms has a hole formed at the detachable end of said actuator arms of said scraping actuator, wherein each of said scraper arms is coupled with said actuator arms through said hole respectively.

8. The waste collector, as recited in claim 7, wherein each of said scraper arms further comprises a bending part extended from the end of said scraper arm to couple with said actuator arms of said scraping actuator, wherein each of said bending part is angled relative to said scraper arm and the body of said waste collecting apparatus is above the extended line of said scraper arms when said scraper arms are scraped the waste on the ground.

9. The waste collector, as recited in claim 8, wherein each of said actuator arms has a hole formed at the detachable end of said actuator arms of said scraping actuator, wherein each of said bending part is coupled with said actuator arm through said hole respectively.

10. The waste collector, as recited in claim 9, wherein each of said scraping teeth has a curved shape and said scraping teeth at one of said scraper arm are misaligned with said scraping teeth at the other of said scraper arm, such that enhance the scraping operation when said scraper arms are moved toward each other.

11. The waste collector, as recited in claim 10, wherein said collecting apparatus further comprises two handles extended from the pivot ends of said actuator arms respectively and used for carrying.

12. A method for collecting waste by a waste collector, comprising the steps of:

(a) providing a bag body with a waste collecting cavity formed between two bag sheets and a top opening for collecting the waste, wherein said bag body further comprises a drawstring extended around said top opening and has two holders upwardly extended from the top of said two bag sheets respectively, wherein said bag body further has at least one sealing slit which is cut in U-shape on each of said bag sheets near said top opening of said bag body;

(b) flipping said bag body inside out from said top opening other to from a temporary waste cavity within said waste collecting cavity thereof;

(c) scraping the waste by moving two scraper arms which are acted on said two bag sheets respectively toward each other;

(d) flipping said bag body back for the waste in said waste collecting cavity from said temporary waste cavity; and (e) tie-closing said waste collecting cavity by said drawstring closing, said holders closing and said sealing slit sealing after the waste is collected therein, wherein an upper edge of said sealing slit is able to be lifted up to make a through hole for said top edge of said bag sheet to be pulled through.

13. The method, as recited in claim 12, wherein in the step (c), said scraper arms are moved toward each other by a scraping actuator which is detachably coupled with said scraper arms, wherein said scraping actuator comprises two actuator arms pivotally coupled with each other and detachably coupled with free end portions of said scraper arms respectively, such that when said actuator arms are pivotally moved, said scraper arms are driven to move toward each other.

14. The method, as recited in claim 13, wherein each of said scraper arms further comprises a bending part extended from the end of said scraper arm to couple with said actuator arms of said scraping actuator, wherein each of said bending part is angled relative to said scraper arm and the body of said waste collecting apparatus is above the extended line of said scraper arms when said scraper arms are scraped the waste on the ground.

* * * * *